US007150115B2

(12) United States Patent
Parker

(10) Patent No.: US 7,150,115 B2
(45) Date of Patent: Dec. 19, 2006

(54) ALL EARTH FOUNDATION TRENCHER

(76) Inventor: Darryll F. Parker, 1771 W. Minnesota Ave., DeLand, FL (US) 32720

( * ) Notice: Subject to any disclaimer, the term of this patent is extended or adjusted under 35 U.S.C. 154(b) by 282 days.

(21) Appl. No.: 10/946,214

(22) Filed: Sep. 21, 2004

(65) Prior Publication Data

US 2006/0059730 A1 Mar. 23, 2006

(51) Int. Cl.
*B65G 33/00* (2006.01)
*E02F 5/04* (2006.01)

(52) U.S. Cl. ..... 37/352; 37/359; 37/360; 37/375; 37/95; 37/463

(58) Field of Classification Search ..... 37/352–362, 37/373–376, 305, 189, 190, 369, 462–465
See application file for complete search history.

(56) References Cited

U.S. PATENT DOCUMENTS

| | | | | |
|---|---|---|---|---|
| 3,750,762 | A * | 8/1973 | Eaton | 173/8 |
| 3,885,332 | A * | 5/1975 | Holland | 37/376 |
| 3,982,688 | A | 9/1976 | Taylor | |
| 4,050,171 | A | 9/1977 | Teach | |
| 4,095,358 | A | 6/1978 | Courson et al. | |
| 4,255,883 | A | 3/1981 | Ealy | |
| 4,871,281 | A * | 10/1989 | Justice | 405/181 |
| 4,908,967 | A | 3/1990 | Leece | |
| 4,936,678 | A | 6/1990 | Gordon et al. | |
| 5,228,220 | A * | 7/1993 | Bryan, Jr. | 37/364 |
| RE34,620 | E | 5/1994 | Camilleri | |
| 5,559,725 | A | 9/1996 | Nielson et al. | |
| 5,639,182 | A | 6/1997 | Paris | |
| 6,014,825 | A * | 1/2000 | Jahn et al. | 37/91 |
| 6,736,216 | B1 | 5/2004 | Savard et al. | |
| 2002/0056211 | A1 | 5/2002 | Kelly et al. | |

* cited by examiner

*Primary Examiner*—Thomas A Beach
(74) *Attorney, Agent, or Firm*—The Livingston Firm; Edward M. Livingston; Angela M. Miller

(57) ABSTRACT

An all-earth foundation trencher has a digger body (1) pivotal selectively on a track-laying chassis (7). The digger body has an earth-mover blade (16) that is manipulatable multi-directionally on a front end. A digger boom (19) has a base end that is pivotal vertically forward from an aft end of the digger body. A digger head (22) is manipulatable on a digger end of the digger boom for power-digging foundation trenches having desired widths and depths in all likely consistencies of earth that ranges from hard and rocky earth to loose dirt. Conveyors (28–31) are positioned intermediate the track-laying chassis and the digger head for conveying removed earth sufficiently far from either or both sides of a foundation trench that the removed earth will not spill back into the foundation trench. A laser guide (99) proximate the digger head provides control assurance of accurate attitudinal digging. Operational controllers (102) include control knobs (104) on knob plates (49) positioned on a control panel (45). The operational controllers are articulated for controlling hydraulic actuators through a control communicator (101) by selective communication with the control knobs for low-profile, convenient and non-fatiguing ergonomic control of operations.

32 Claims, 11 Drawing Sheets

ALL EARTH FOUNDATION TRENCHER

This invention relates to earth-moving vehicles that include precision foundation trenchers which remove all likely consistencies of earth, ranging from hard and rocky earth to loose dirt, and which pile the earth in ridges spaced stably apart from foundation trenches without manual labor.

Foundation trenches are widely known and used. None, however, are known to be capable of blade-clearing trench areas, removing all likely consistencies of soil, ranging from hard and rocky earth to loose dirt, and placing the earth stably apart from foundation trenches without manual labor in a manner taught by this invention.

Prior art found to be related but different includes the following:

| U.S. Pat. No. | Inventor | Date |
|---|---|---|
| 3,982,688 | Taylor | Sep. 28, 1976 |
| 4,050,171 | Teach | Sep. 27, 1977 |
| 4,095,358 | Courson et al. | Jun. 20, 1978 |
| 4,255,883 | Ealy | Mar. 17, 1981 |
| 4,908,967 | Leece | Mar. 20, 1990 |
| 4,936,678 | Gordon et al | Jun. 26, 1990 |
| Re. 34,620 | Camilleri | May 31, 1994 |
| 5,559,725 | Nielson et al. | Sep. 24, 1996 |
| 5,639,182 | Paris | Jun. 17, 1997 |
| 2002/0056211 A1 | Kelly et al. | May 16, 2002 |
| 6,736,216 B2 | Savard et al. | May 18, 2004 |

SUMMARY OF THE INVENTION

Objects of patentable novelty and utility taught by this invention are to provide an all-earth foundation trencher which:

can blade-clear foundation-trench area ahead of it without manual labor for supporting earth-mover track and for containing ridges of moved earth that are spaced stably apart from a foundation trench dug with an aft portion of the all-earth foundation trencher;

can maintain precise verticality of a mechanized digger and resulting required preciseness of verticality of trench walls on variably horizontal, sloped and uneven foundation-trench areas;

has endless-track mobility for rigid vehicle support of the mechanized digger;

can dig all likely consistencies of soil, ranging from hard and rocky earth to loose dirt;

can place the earth stably apart from foundation trenches; and can dig predeterminedly variable trench widths and depths.

This invention accomplishes these and other objectives with an all-earth foundation trencher having a digger body pivotal selectively on a track chassis. The digger body has an earth-mover blade that is manipulatable multi-directionally on a front end. A digger boom has a base end that is pivotal vertically on a boom base that is predeterminedly forward from an aft end of the digger body. The digger boom has a digger end extended rearward from the digger body. A digger head is manipulatable on the digger end of the digger boom for power-digging foundation trenches having desired widths and depths in all likely consistencies of soil, ranging from hard and rocky earth to loose dirt. Conveyors are positioned intermediate the track chassis and the digger head for conveying removed earth sufficiently far from either or both sides of a foundation trench that the removed earth will not spill back into the foundation trench. Form blades can be positioned proximate opposite sides of the digger head for forming walls on trench sides of berms to further assure that removed earth will not spill back into the foundation trenches. A compaction roller can be positioned aft of the digger head where it can be articulated to bear sufficient weight of the all-earth foundation trencher for a reliable concrete base. A laser guide proximate the digger head provides accurate directional and attitudinal digging with the digger head.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
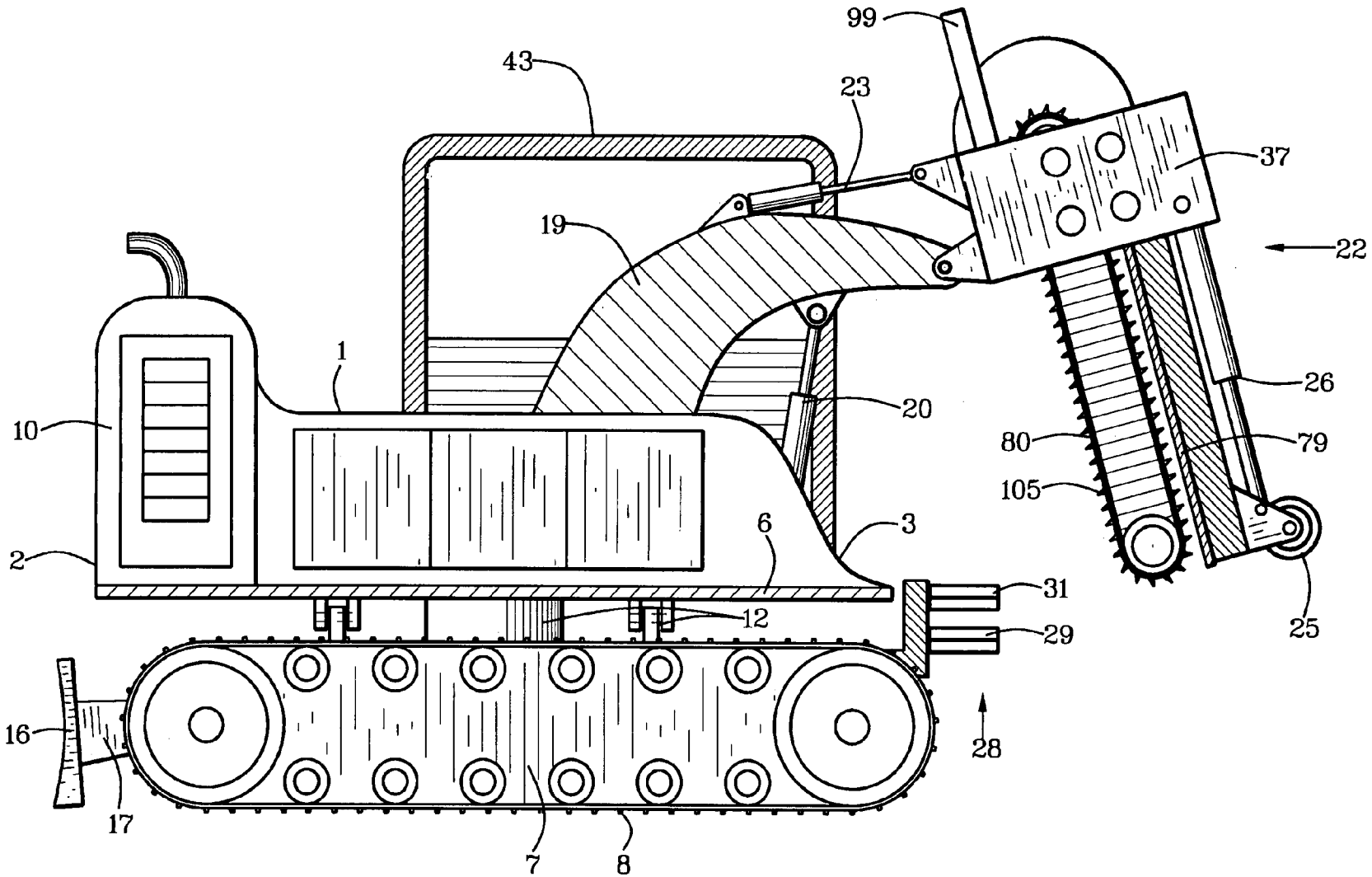
FIG. 1 is a side elevation view of the all-earth foundation trencher with a digger head in a raised mode.

A description of the preferred embodiment of this invention follows a list of numbered terms which designate its features with the same numbers on the drawings and in parentheses throughout the description and throughout the patent claims.

| | |
|---|---|
| 1. | Digger body |
| 2. | Blade end |
| 3. | Digger end |
| 4. | First side |
| 5. | Second side |
| 6. | Chassis-attachment base |
| 7. | Track-laying chassis |
| 8. | First track |
| 9. | Second track |
| 10. | Prime mover |
| 11. | Control-power source |
| 12. | Chassis connection |
| 13. | Control-power distributor |
| 16. | Earth-mover blade |
| 17. | Blade-control beams |
| 19. | Digger boom |
| 20. | Boom-control rod |
| 22. | Digger head |
| 23. | Head-control rod |
| 25. | Compact roller |
| 26. | Compaction-control rod |
| 27. | Compaction controller |
| 28. | Earth conveyor |
| 29. | First-side conveyor |
| 30. | Second-side conveyor |
| 31. | Central conveyor |
| 32. | First-conveyor control rod |
| 33. | First-conveyor controller |
| 34. | Second-conveyor control rod |
| 35. | Second-conveyor controller |
| 36. | Conveyance-direction controller |
| 37. | Safety panels |
| 38. | Safety control rods |
| 39. | Safety controller |
| 40. | Pile blades |
| 41. | Pile-control rods |
| 42. | Pile controller |
| 43. | Pilot house |
| 44. | Operator seat |
| 45. | Control panel |
| 46. | Directional indicator |
| 47. | Body-direction point |
| 48. | Chassis-direction point |
| 49. | Knob plate |
| 50. | Verticality indicator |
| 51. | Body-verticality point |
| 52. | Chassis-verticality point |
| 53. | Ball-and-socket controller |
| 54. | Ball |
| 55. | Socket |

-continued

| | |
|---|---|
| 56. | Blade plate |
| 57. | Epicentral knob |
| 58. | Boom-controller knob |
| 59. | Depth point |
| 60. | Up mark |
| 61. | Down mark |
| 62. | Boom plate |
| 63. | Incremental marks |
| 64. | Dig-width knob |
| 65. | Head-slant knob |
| 66. | Dig-speed knob |
| 67. | Width point |
| 68. | Min-width mark |
| 69. | Max-width mark |
| 70. | Width-indicator plate |
| 71. | Slant point |
| 72. | No-slant mark |
| 73. | Max-slant mark |
| 74. | Slant-indicator plate |
| 75. | Speed point |
| 76. | Stop mark |
| 77. | Max-speed mark |
| 78. | Speed-indicator plate |
| 79. | Digger backboard |
| 80. | Cutter chain |
| 81. | Central digger chain |
| 82. | Left digger chain |
| 83. | Right digger chain |
| 84. | Chain-sprocket teeth |
| 85. | Top-central chain wheel |
| 86. | Bottom-central chain wheel |
| 87. | Top-left chain wheel |
| 88. | Bottom-left chain wheel |
| 89. | Top-right chain wheel |
| 90. | Bottom-right chain wheel |
| 91. | Top sprocket axle |
| 92. | Bottom sprocket axle |
| 93. | Sprocket-wheel slider |
| 94. | Backboard first side |
| 95. | Backboard second side |
| 98. | Backboard-width controller |
| 99. | Laser guide |
| 100. | Accuracy controller |
| 101. | Control communicator |
| 102. | Operational controllers |
| 104. | Control knob |
| 105. | Rock-digger blades |
| 106. | Directional reference point |

Referring to FIGS. 1–8, the all-earth foundation trencher has a digger body (1) with a blade end (2), a digger end (3), a first side (4), a second side (5) and a chassis-attachment base (6) on a track-laying chassis (7). The track-laying chassis (7) has a first track (8) and a second track (9). A prime mover (10) is positioned preferably on proximate the blade-end of the digger body (1).

The prime mover (10) has power-transfer communication with a control-power source (11) on the digger body (1) for providing power for operating components of the all-earth foundation trencher. Preferably for most operational components, the power provided by the control-power source (11) is hydraulic fluid pressure. This is basically a hydraulic-power system. However, some components and some portions of components are articulated to require some electrical, others some pneumatic power and others mechanical power. All are provided by the control-power source (11).

A chassis connection (12) is in predetermined communication intermediate the chassis-attachment base (6) on the digger body (1) and the track-laying chassis (7). In addition to providing standard mechanical and hydraulic linkage predeterminedly from the prime mover (10) to the first track (8), to the second track (9) and to other operational components on the track-laying chassis (7), the chassis connection (12) also provides novel verticality pivot of the digger body (1) on a pivot axis that is collinear to linear axes of the track-laying chassis (7), the first track (8) and the second track (9). This allows control of verticality of a digger head (22) that is orthogonal to the digger body (1).

The control-power source (11) has control-power communication with a control-power distributor (13) that is positioned on the digger body (1).

The chassis connection (12) includes track-directional communication of control of mobility of the first track (8) and the second tract (9) with a mobility controller in communication with the control-power distributor (13). The chassis connection (12) includes body-orientational control of orientation that includes at least verticality of the digger body (1) in relationship to orientation of the track-laying chassis (7) with an orientation controller in communication with the control-power distributor (13).

An earth-mover blade (16) is manipulatable on blade-control beams (17) projected from a blade-attachment portion of the track-laying chassis (7). The earth-mover blade (16) has a predetermined plurality of directional orientations controlled by a blade controller in communication with the control-power distributor (13).

A digger boom (19) is pivotal vertically from a boom-attachment portion of the digger body (1). The digger boom (19) is manipulated vertically with at least one boom-control rod (20) having a boom controller in communication with the control-power distributor (13).

A digger head (22) is pivotal vertically on a digger-attachment portion of the digger boom (19). The digger head (22) is manipulated vertically with at least one head-control rod (23). The digger head (22) has a head controller in communication with the control-power distributor (13).

A digger backboard (79) is positioned aft of a cutter chain (80) of the digger head (22) for deterring loose earth from falling from the cutter chain (80).

A compact roller (25) is positioned proximate a bottom-aft portion of the digger head (22) with the compact roller (25) being manipulated vertically on the digger head (22) with at least one compaction-control rod (26) having a compaction controller (27) in communication with the control-power distributor (13).

An earth conveyor (28) is positioned predeterminedly intermediate the digger head (22) and a conveyor-attachment portion of the track-laying chassis (7). The earth conveyor (28) includes a first-side conveyor (29), a second-side conveyor (30) and at least one central conveyor (31). The first-side conveyor (29) is manipulated horizontally with at least one first-conveyor control rod (32) having a first-conveyor controller (33) in communication with the control-power distributor (13). The second-side conveyor (30) is manipulated horizontally with at least one second-conveyor control rod (34) having a second-conveyor controller (35) in communication with the control-power distributor (13). The central conveyor (31) is articulated for conveying earth to the first-side conveyor (29) and to the second-side conveyor (30) selectively with a conveyance-direction controller (36) in communication with the control-power distributor (13).

Safety panels (37) are manipulated vertically and laterally proximate opposite sides of the digger head (22) with safety control rods (38) having a safety controller (39) in communication with the control-power distributor (13).

Pile blades (40) are manipulated vertically and horizontally proximate opposite sides of the digger head (22) with pile-control rods (41) having a pile controller (42) in communication with the control-power distributor (13).

A pilot house (43) is positioned and articulated on the digger body (1) for forward visibility of earth-mover-blade factors and rearward for visibility of earth-digger factors from an operator seat (44) in control-operable proximity to a control panel (45) in operable relationship to the control-power distributor (13).

The chassis connection (12) can include predetermined universality. The universality can include directional rotation of the digger body (1) in relationship to linear direction of the first track (8) and the second track (9) of the track-laying chassis (7). The universality can include verticality pivot of the digger body (1) in relationship to horizontality of the first track (8) and the second track (9) of the track-laying chassis (7).

Figure 24:
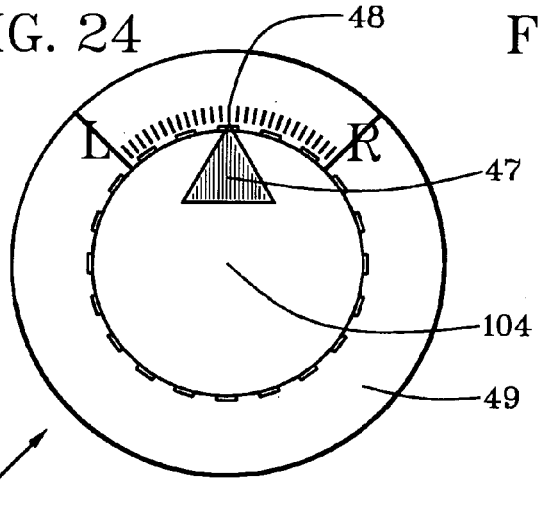
FIG. 24 is a top view of a mobility-controller knob for directional control of chassis travel.
Figure 28:
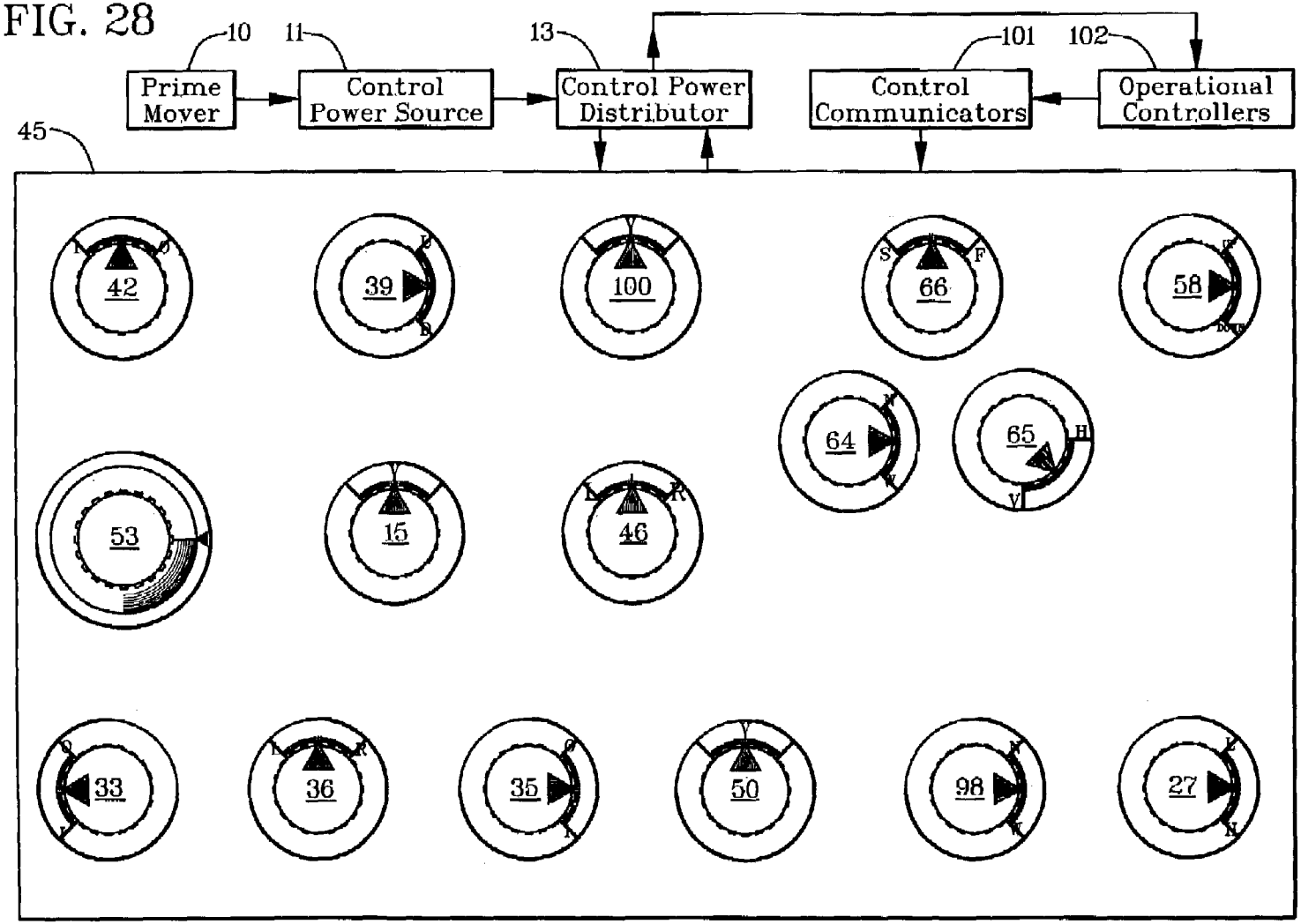
FIG. 28 is a schematic of controls in relationship to the control panel.

Referring to FIGS. 24 and 28, the mobility controller can include a directional indicator (46) having a body-direction point (47) for selective steering-control alignment of the digger body (1) and the track-laying chassis (7) by aligning the body-direction point (47) with a chassis-direction point (48) on a knob plate (49).

Figure 14:
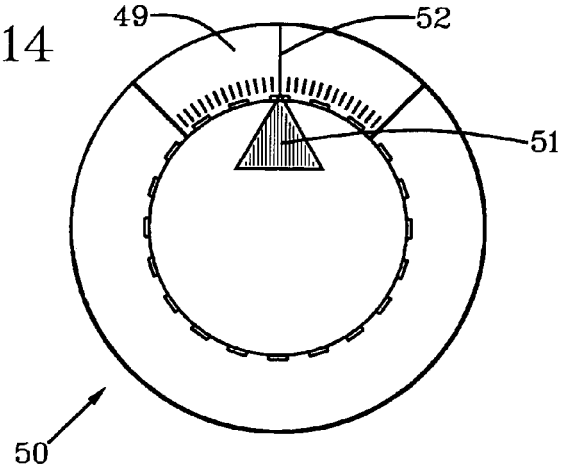
FIG. 14 is a top view of a verticality-control knob.

Referring to FIGS. 14 and 28, a verticality controller can include a verticality indicator (50) having a body-verticality point (51) and a chassis-verticality point (52) on the knob plate (49) for selectively aligning verticality of the digger body (1) with verticality of the track-laying chassis (7) by aligning the body-verticality point (51) with the chassis-verticality point (52).

The directional indicator (46) and the verticality indicator (50) are preferably articulated with a low profile and positioned on the control panel (45) for ease of access and visibility and for avoidance of unintended actuation.

The directional indicator (46) preferably includes precise measurement, readout and fixedly automatic control of steering-control alignment for precise directional control of trench digging.

The verticality indicator (50) preferably includes laser-precision measurement, readout and fixedly automatic control of body verticality for precise verticality control of trench digging with the digger head (22).

Referring to FIGS. 5–9 and 28, for plural-way controllability of blade orientation on the blade control beams (17), the blade controller can include a ball-and-socket controller (53) having a ball (54) that is rotational universally in socket (55) in a blade plate (56) with the ball-and-socket controller (53) being articulated for controlling orientation of the earth-mover blade (16). The ball (54) has an epicentral knob (57) that is rotational clockwise from a directional-reference point (106) on the blade plate (56) for clockwise steering of the earth-mover blade (16) clockwise from orthogonality to a linear axis of the track-laying chassis (7). The epicentral knob (57) is rotational counterclockwise from the directional-reference point (106) on the blade plate (56) for steering the earth-mover blade (16) counterclockwise from orthogonality to the linear axis of the track-laying chassis (7). The epicentral knob (57) is pivotal downward for orienting the earth-mover blade (16) clockwise from horizontality and is pivotal upward for orienting the earth-mover blade (16) counterclockwise from horizontality. The epicentral knob (57) is pivotal horizontally forward for orienting the earth-mover blade (16) clockwise from verticality and is pivotal vertically rearward for orienting the earth-mover blade (16) counterclockwise from verticality.

The ball-and-socket controller (53) is articulated with a low profile and positioned on the control panel (45) for ease of access and visibility and for avoidance of unintended actuation.

The ball-and-socket controller (53) preferably includes precise measurement, readout and fixedly automatic control of orientation of the earth-mover blade (16) for desirably precise mechanized clearing, grading and leveling of foundation-trench areas, for accurate track mobility and for reliable piling of removed earth beside foundation trenches.

Figure 10:
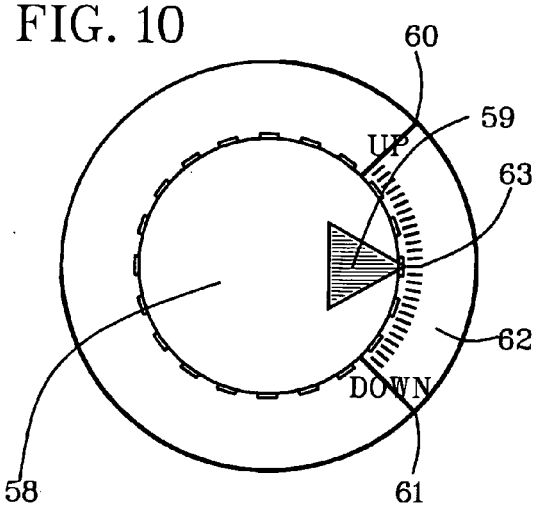
FIG. 10 is a top view of a boom-controller knob for raising and lowering a digger boom.
Figure 11:
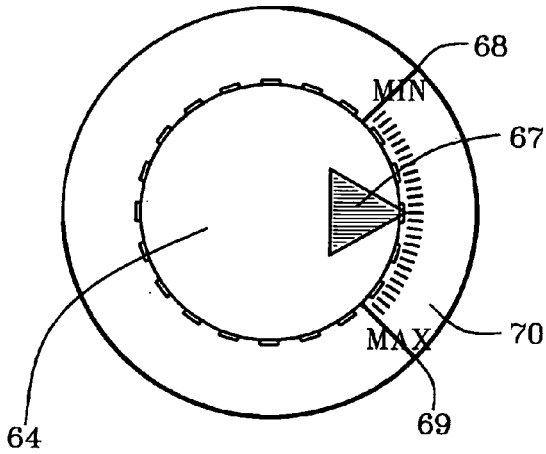
FIG. 11 is a top view of a dig-width knob for controlling digger-head width.
Figure 12:
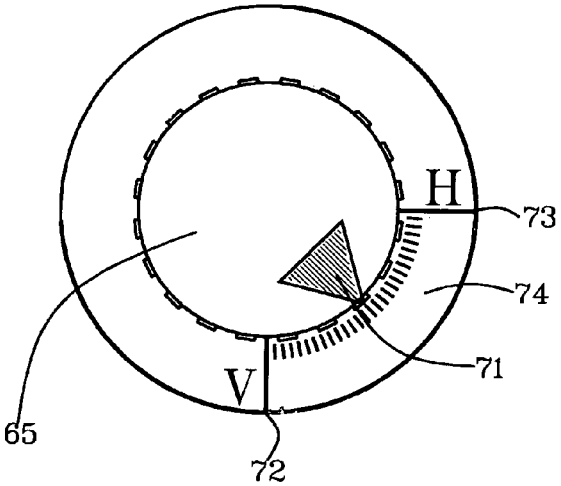
FIG. 12 is a top view of a head-slant knob for controlling digger-head slant.
Figure 13:
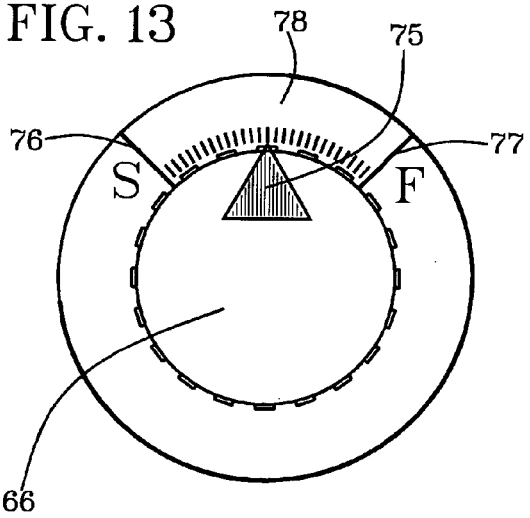
FIG. 13 is a top view of a dig-speed knob for controlling digger-head speed.

Referring to FIGS. 10 and 28, the boom controller can includes a boom-controller knob (58) that is articulated for controlling the digger boom (19) with a depth point (59) that is rotational clockwise selectively intermediate an up mark (60) and a down mark (61) on a boom plate (62) on the control panel (45) for lowering the digger boom (19). The depth point (59) is rotational counterclockwise selectively intermediate the down mark (61) and the up mark (60) for raising the digger boom (19).

The boom-controller knob (58) is articulated preferably with a low profile and positioned on the control panel (45) for ease of access and visibility and for avoidance of unintended actuation.

The boom controller preferably includes selectively precise measurement, readout and fixedly automatic control of digging depth of the digger head (22) by rotation of the boom-controller knob (58).

Measurement of digging depth can include incremental marks (63) on the boom plate (62) intermediate the up mark (60) and the down mark (61).

Referring to FIGS. 11–13 and 28, the head controller can include a dig-width knob (64) articulated for controlling dig width of the digger head (22), a head-slant knob (65) articulated for controlling slant of the digger head (22) and dig-speed knob (66) articulated for controlling dig speed of the digger head (22).

The dig-width knob (64) has a width point (67) that is rotational selectively intermediate a min-width mark (68) and a max-width mark (69) on a width-indicator plate (70) for width control.

The head-slant knob (65) has a slant point (71) that is rotational selectively intermediate a no-slant mark (72) and a max-slant mark (73) on a slant-indicator plate (74) for slant control.

The dig-speed knob (66) has a speed point (75) that is rotational selectively intermediate a stop mark (76) and a max-speed mark (77) on a speed-indicator plate 20 (78) for dig-speed control.

The dig-width knob (64), the head-slant knob (65) and the dig-speed knob (66) can include a group of three separate knobs on the control panel (45).

Figure 15:
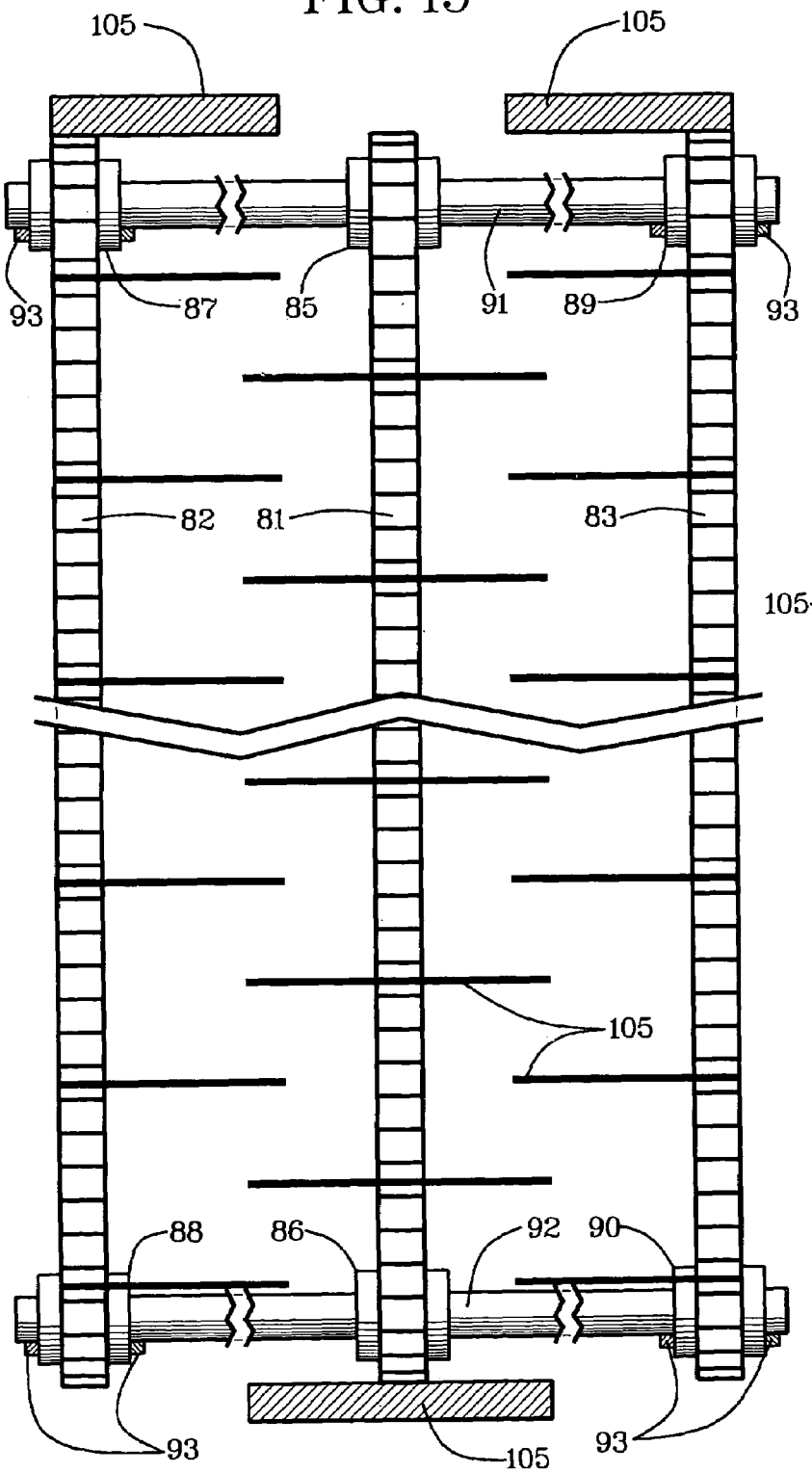
FIG. 15 is a partially cutaway fragmentary front view of a rock-digger variable-width digger chain.
Figure 16:
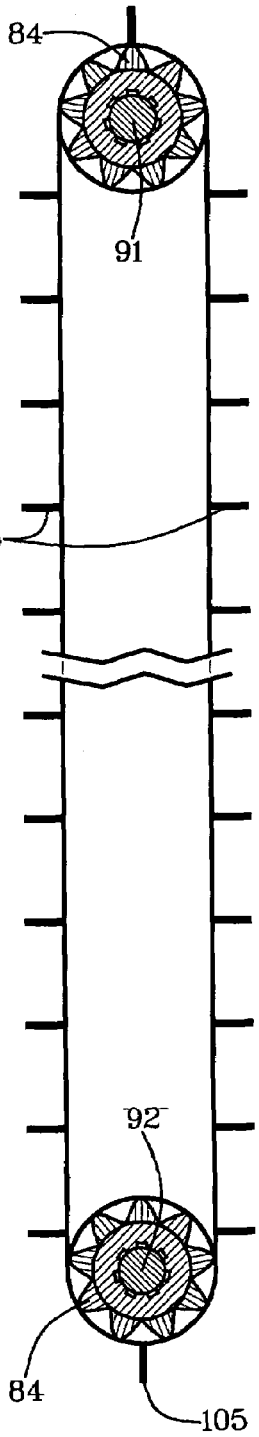
FIG. 16 is a side view of the FIG. 15 illustration.
Figure 17:
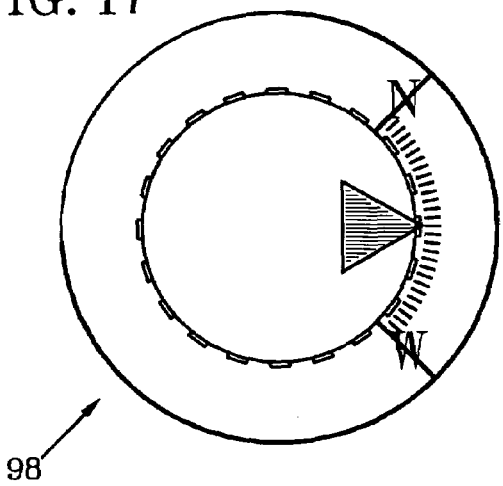
FIG. 17 is a top view of a backboard-width knob for controlling backboard width.

Referring to FIGS. 15–16, the digger head (22) preferably includes a central digger chain (81), a left digger chain (82) and a right digger chain (83). The central 25 digger chain (81) is positioned on chain-sprocket teeth (84) of a top-central chain wheel (85) and on bottom-central chain wheel (86). The left digger chain (82) is positioned on chain-sprocket teeth (84) of a top-left chain wheel (87) and on chain-sprocket teeth (84) of a bottom-left chain wheel (88). The right digger chain (83) is positioned on chain-sprocket teeth (84) of a top-right chain wheel (89) and on chain-sprocket teeth (84) of a bottom-right chain wheel (90). The top-central chain wheel (85) is affixed to a central portion of a top sprocket axle (91) and the bottom-central chain wheel (86) affixed to a central portion of a bottom sprocket axle (92).

The top-left chain wheel (87) and the top-right chain wheel (89) are in linearly sliding contact with the top sprocket axle (91). The bottom-left chain wheel (88) and the bottom-right chain wheel (90) are in linearly sliding contact with the bottom sprocket axle (92).

The head controller includes a sprocket-wheel slider (93) that is operable by the dig-width knob (64) for controlling dig width of the digger head (22).

Referring to FIGS. 1–4, the digger backboard (79) includes a backboard first side (94) positioned proximate a first side of the digger head (22) and a backboard second side (95) positioned proximate a second side of the digger head (22). The backboard first side (94) and the backboard second side (95) have portions that are overlapped selectively for desired combined width thereof. Combined width of the backboard first side (94) and the backboard second side (95) is manipulated by a backboard-width controller (98) in communication with the control-power distributor (13).

The backboard-width controller (98) is articulated with a low profile that includes a knob positioned on the control panel (45) for ease of access and visibility and for avoidance of unintended actuation.

Figure 18:
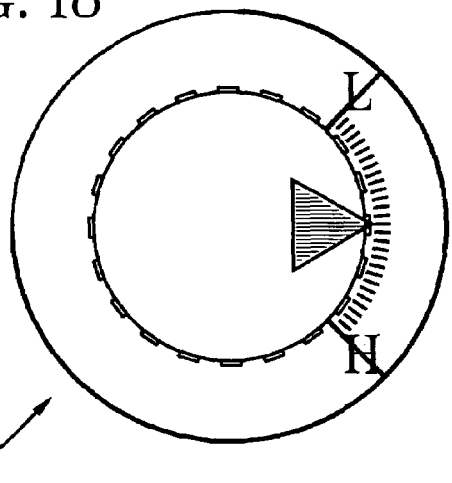
FIG. 18 is a top view of a compaction-controller knob for controlling compaction pressure.
Figure 19:
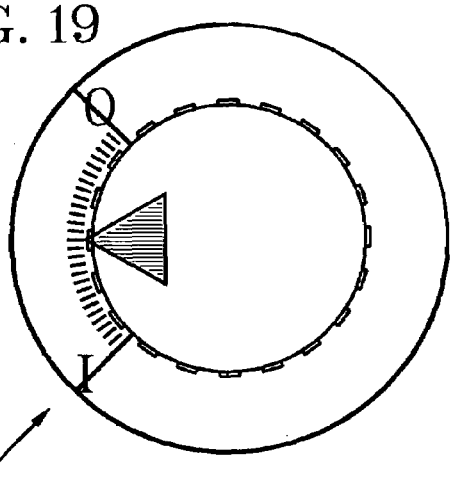
FIG. 19 is a top view of a first-conveyor controller knob for controlling reach of a first-side conveyor.
Figure 20:
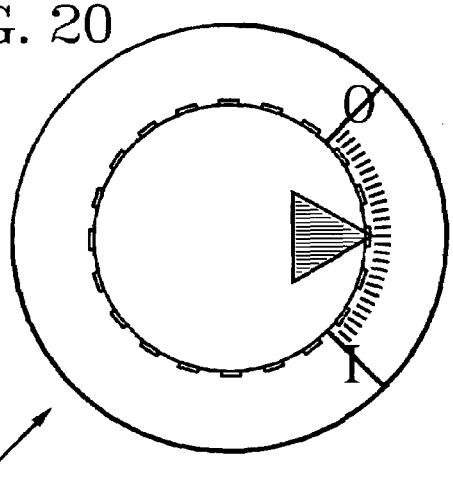
FIG. 20 is a top view of a second-conveyor controller knob for controlling reach of a second-side conveyor.
Figure 21:
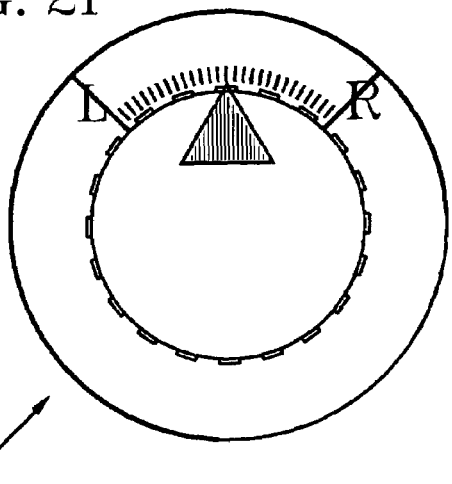
FIG. 21 is a top view of a conveyor-direction controller knob for controlling conveyance direction.

Referring to FIGS. 18 and 28, the compaction controller (27) is articulated with a low profile that includes a knob positioned on the control panel (45) for ease of access and visibility and for avoidance of unintended actuation.

Referring to FIGS. 19–21 and 28, the first-conveyor controller (33), the second-conveyor controller (35) and the conveyance-direction controller (36) are articulated with low profile that includes at least one knob positioned on the control panel (45) for ease of access and visibility and for avoidance of unintended actuation.

Figure 22:
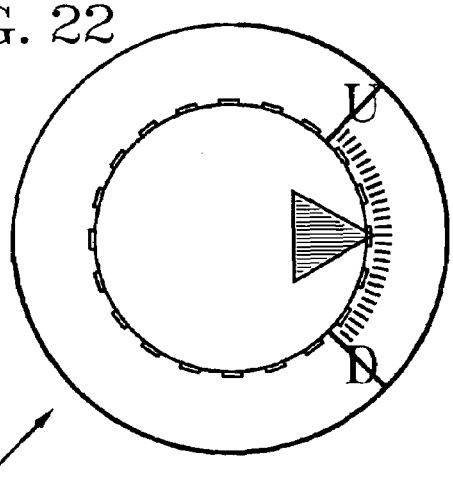
FIG. 22 is a top view of a safety-controller knob for positioning safety panels.

Referring to FIGS. 22 and 28, the safety controller (39) is articulated with low profile that includes at least one knob positioned on the control panel (45) for ease of access and visibility and for avoidance of unintended actuation.

Figure 23:
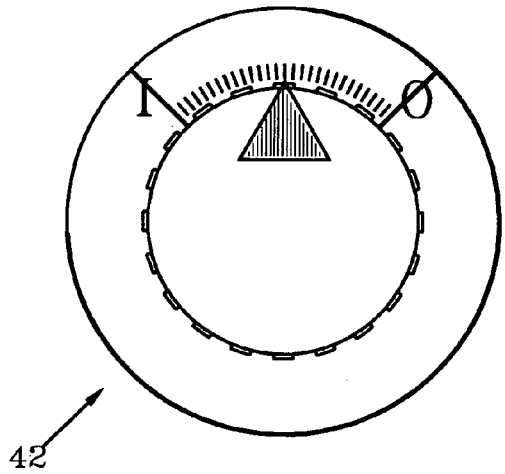
FIG. 23 is a top view of a pile-controller knob for firming up ridges of piled earth at sides of trenches.

Referring to FIGS. 23 and 28, the pile controller (42) is articulated with low profile that includes at least one knob positioned on the control panel (45) for ease of access and visibility and for avoidance of unintended actuation.

Figure 25:
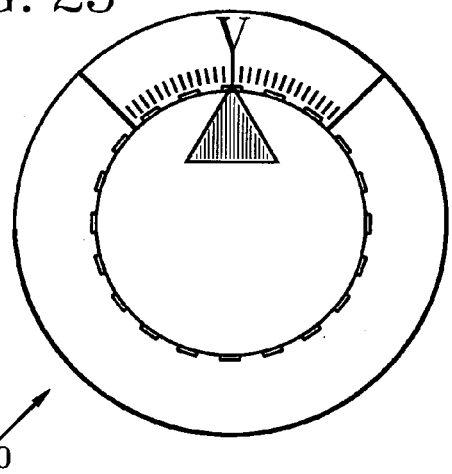
FIG. 25 is a top view of an accuracy-controller knob for override of automated laser control of verticality of trench walls.

Referring to FIGS. 1, 25 and 28, at least one laser guide (99) is articulated and positioned proximate the digger head (22) for control-assurance feedback of verticality accuracy of trench digging to an accuracy controller (100) on the control panel (45).

Figure 2:
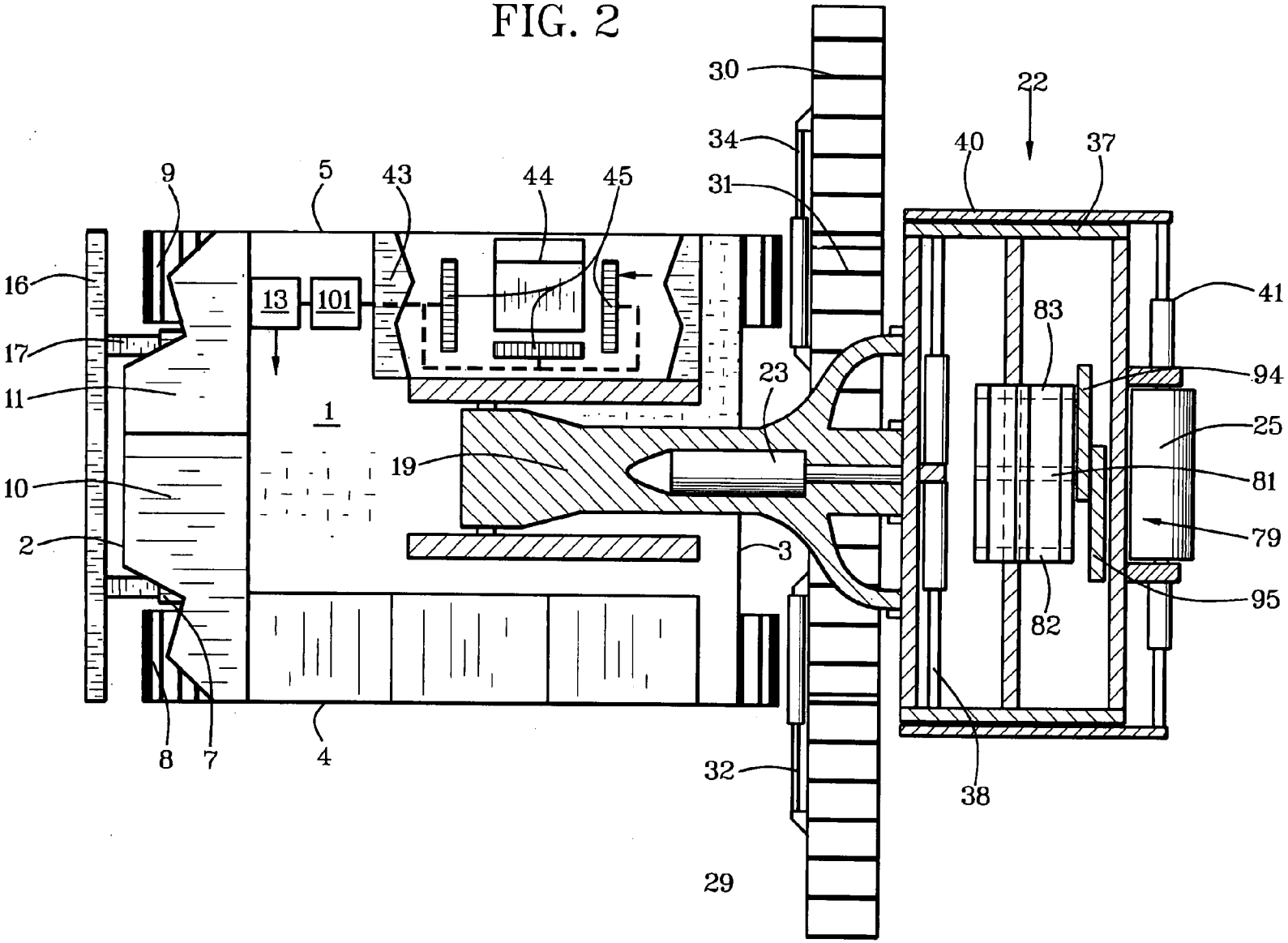
FIG. 2 is a partially cutaway top view.
Figure 3:
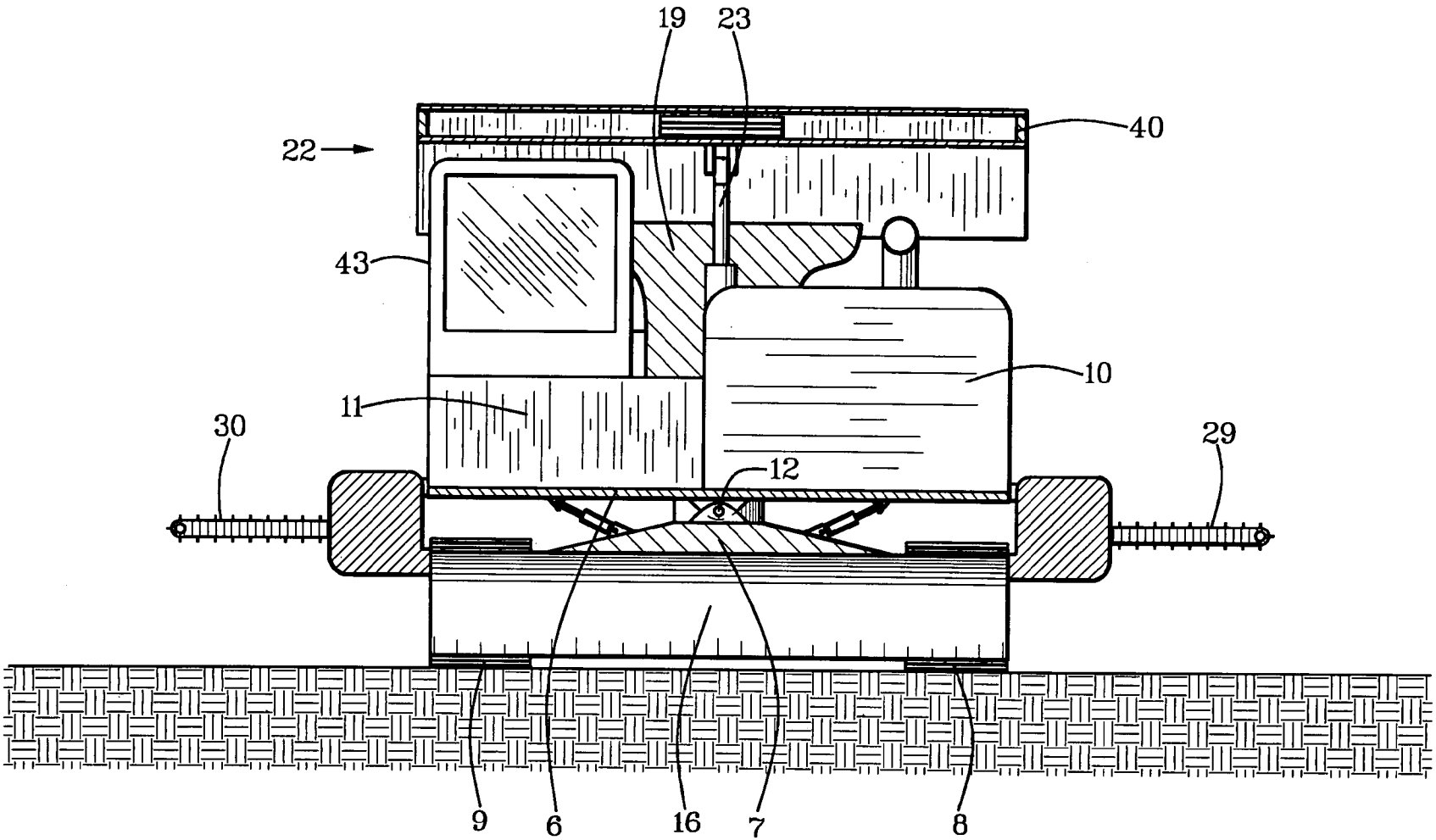
FIG. 3 is a front view.
Figure 4:
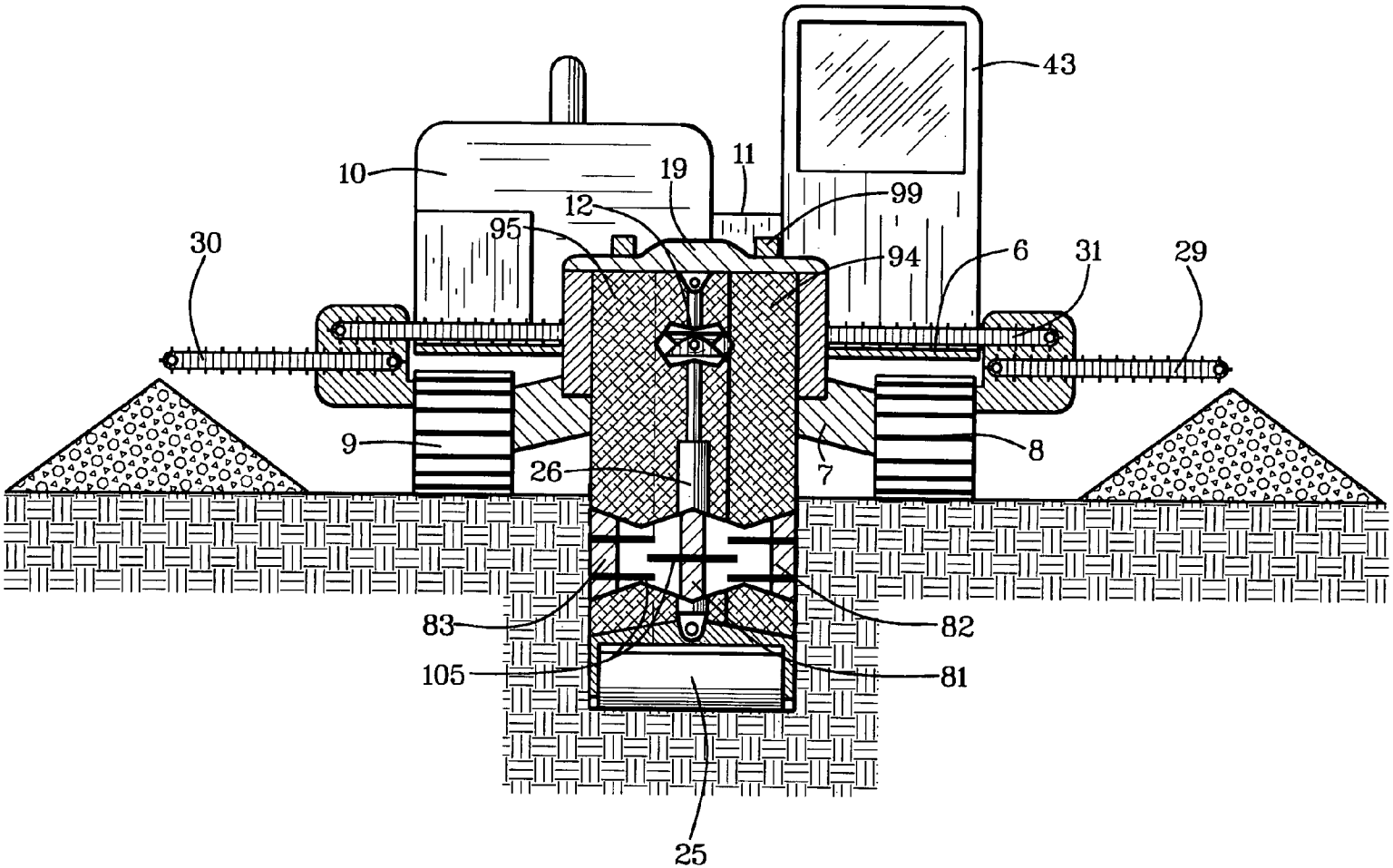
FIG. 4 is a partially cutaway rear view with the digger head in a lowered digging mode.
Figure 5:
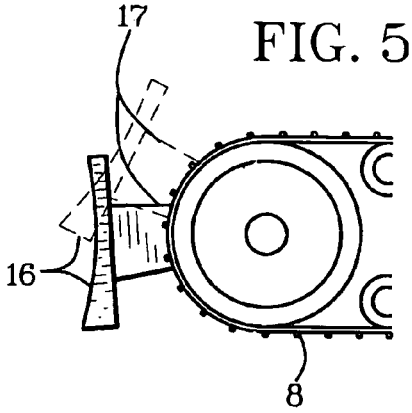
FIG. 5 is a fragmentary side view of a front corner showing an earth-mover blade in down mode with solid lines and in an up mode with dashed lines.
Figure 6:
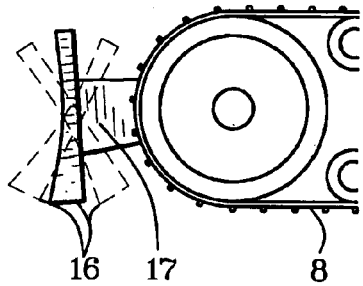
FIG. 6 is a fragmentary side view of the front corner showing the earth-mover blade in down mode with solid lines and slanted in forward and aft modes with dashed lines.
Figure 7:
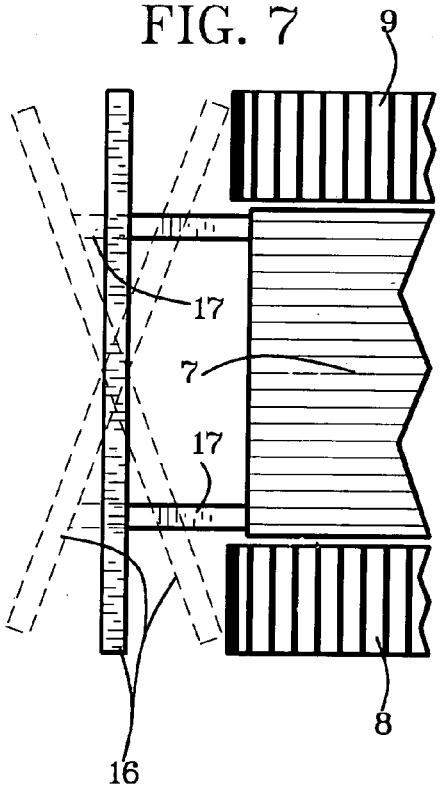
FIG. 7 is a fragmentary top view of a front portion of a track-laying chassis and tracks showing the earth-mover blade in an orthogonal mode in relationship to the tracks with solid lines and beveled laterally with dashed lines.
Figure 8:
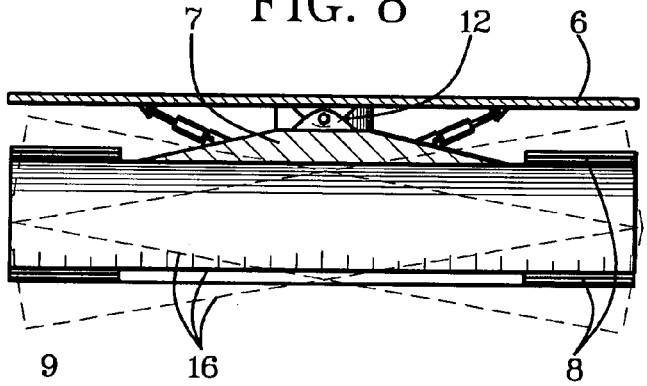
FIG. 8 is a fragmentary front view of a front portion of a track-laying chassis and tracks showing the earth-mover blade in an orthogonal mode in relationship to the tracks with solid lines and beveled vertically with dashed lines.
Figure 9:
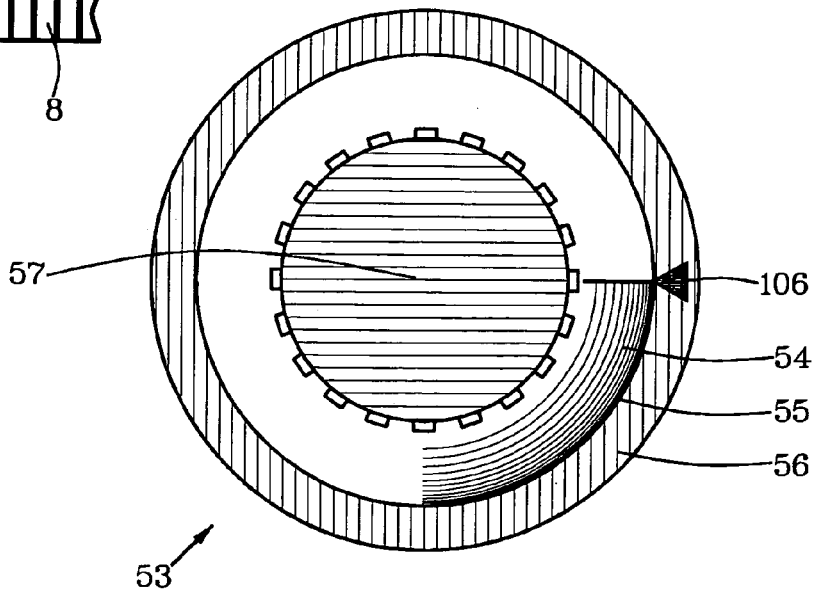
FIG. 9 is a top view of a ball-and-socket controller of orientation and modes of the earth-mover blade.

Referring to FIGS. 2 and 28, the control-power source (11) includes hydraulic power in communication from the control-power distributor (13) to operational controllers (102) of operational components of the all-earth foundation trencher. The operational controllers (102) include control communication of hydraulic actuators of the operational components. Control-power communication of the operational controllers (102) with the control-power distributor (13) includes communication through a predetermined control communicator (101) which can include hydraulic, mechanical and electrical components.

Figure 26:
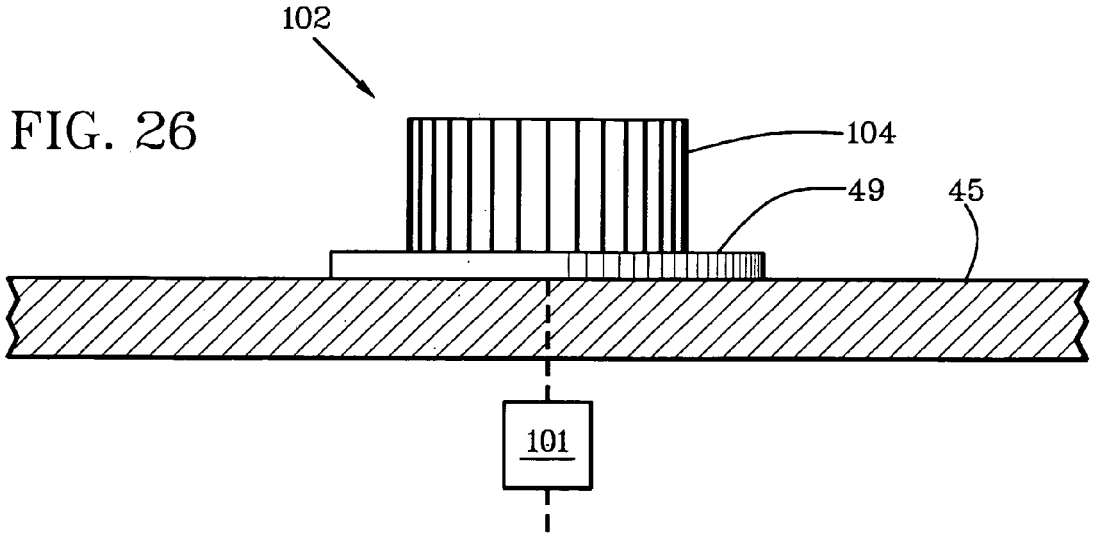
FIG. 26 is a fragmentary side view of representative operational controllers with a control knob in relationship to a knob plate on the control panel with control communication through a control communicator.
Figure 27:
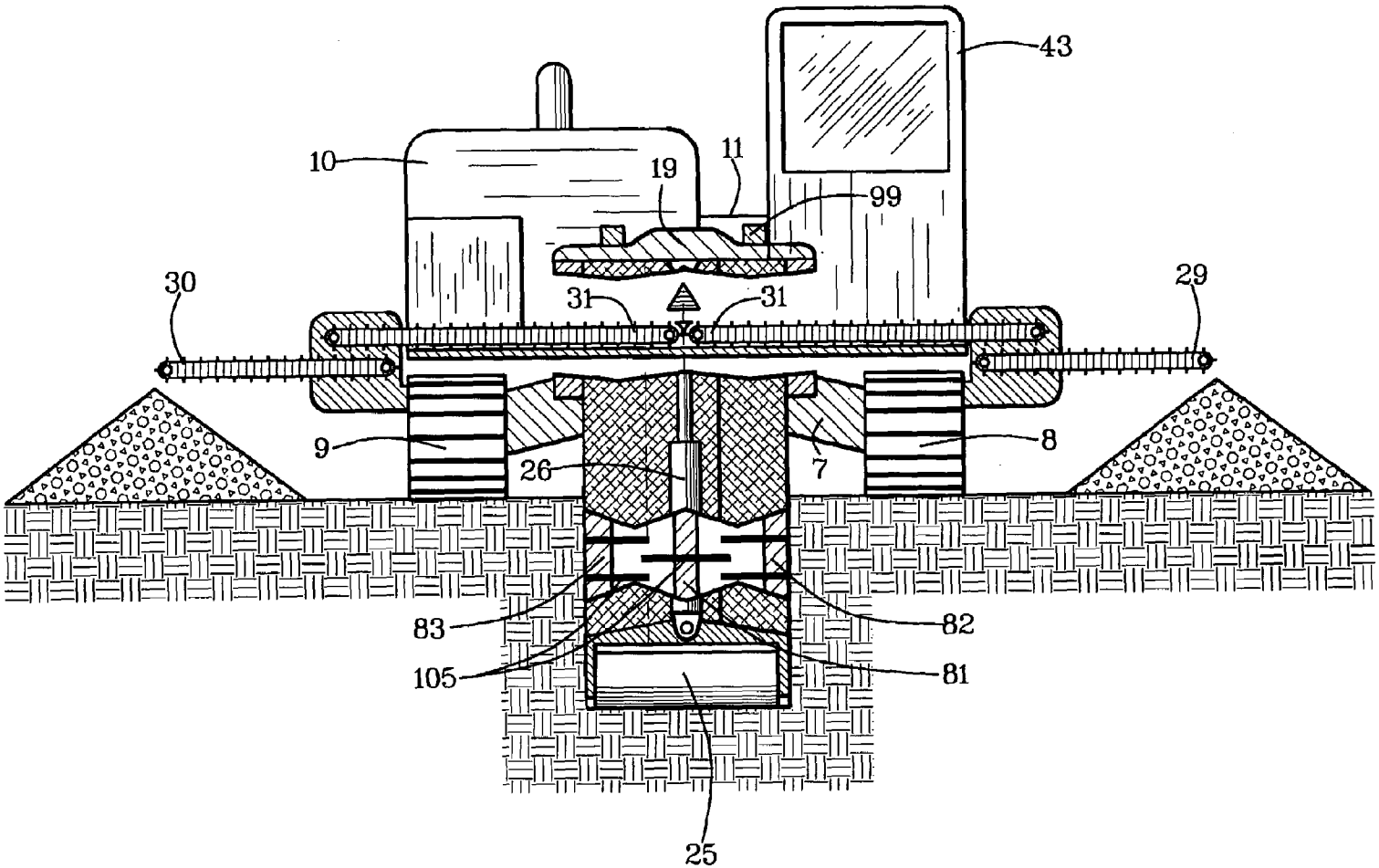
FIG. 27 is a partially cutaway rear view of the all-earth foundation trencher showing two-side conveyance of earth with the digger head in a lowered digging mode.

Referring to FIGS. 26 and 28, the operational controllers (102) can include control knobs (104) on knob plates (49) positioned on the control panel (45). The operational controllers (102) are articulated for controlling the hydraulic actuators through the control communicator (101) by selective communication with the control knobs (104).

A new and useful all-earth foundation trencher having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. An all-earth foundation trencher comprising:

a digger body having a blade end, a digger end, a first side, a second side and a chassis-attachment base;

a track-laying chassis having a first track and a second track;

a prime mover on the digger body;

a control-power source on the digger body;

the prime mover having power-transfer communication with the control-power source;

a chassis connection in predetermined communication intermediate the chassis-attachment base on the digger body and the track-laying chassis;

a control-power distributor on the digger body;

the control-power source having control-power communication with the control-power distributor;

the chassis connection including track directional communication of control of mobility of the first track and the second tract with a mobility controller in communication with the control-power distributor;

the chassis connector including body-orientational control of orientation that includes at least verticality of the digger body in relationship to orientation of the track-laying chassis with an orientation controller in communication with the control-power distributor;

an earth-mover blade on blade-control beams projected from a blade-attachment portion of the track-laying chassis;

the earth-mover blade having a predetermined plurality of directional orientations controlled by a blade controller in communication with the control-power distributor;

a digger boom pivotal vertically from a boom-attachment portion of the digger body;

the digger boom being manipulated vertically with at least one boom-control rod having a boom controller in communication with the control-power distributor;

a digger head pivotal vertically on a digger-attachment portion of the digger boom;

the digger head being manipulated vertically with at least one head-control rod and the digger head having a head controller in communication with the control-power distributor;

a digger backboard positioned aft of a cutter chain of the digger head for deterring loose earth from falling from the cutter chain;

a compact roller positioned proximate a bottom-aft portion of the digger head;

the compact roller being manipulated vertically on the digger head with at least one compaction-control rod having a compaction controller in communication with the control-power distributor;

an earth conveyor positioned predeterminedly intermediate the digger head and a conveyor-attachment portion of the track-laying chassis;

the earth conveyor including a first-side conveyor, a second-side conveyor and at least one central conveyor;

the first-side conveyor being manipulated horizontally with at least one first-conveyor control rod having a first-conveyor controller in communication with the control-power distributor;

the second-side conveyor being manipulated horizontally with at least one second-conveyor control rod having a second-conveyor controller in communication with the control-power distributor;

the central conveyor being articulated for conveying earth to the first-side conveyor and to the second-side conveyor selectively with a conveyance-direction controller in communication with the control-power distributor;

safety panels manipulated vertically and laterally proximate opposite sides of the digger head with safety control rods having a safety controller in communication with the control-power distributor;

pile blades manipulated vertically and horizontally proximate opposite sides of the digger head with pile-control rods having a pile controller in communication with the control-power distributor; and a pilot house positioned and articulated on the digger body for forward visibility of earth-mover-blade factors and rearward for visibility of earth-digger factors from an operator seat in control-operable proximity to a control panel in operable relationship to the control-power distributor.

2. The all-earth foundation trencher of claim 1 wherein:

the chassis connection includes predetermined universality;

the universality includes directional rotation of the digger body in relationship to linear direction of the first track and the second track of the track-laying chassis; and the universality includes verticality pivot of the digger body in relationship to horizontality of the first track and the second track of the track-laying chassis.

3. The all-earth foundation trencher of claim 2 wherein:

the mobility controller includes a directional indicator having a body-direction point for selective steering-control alignment of the digger body and the track-laying chassis by aligning the body-direction point with a chassis-direction point on a knob plate;

the verticality controller includes a verticality indicator having a body-verticality point and a chassis-verticality point on the knob plate for selectively aligning verticality of the digger body with verticality of the track-laying chassis by aligning the body-verticality point with the chassis-verticality point; and the directional indicator and the verticality indicator being articulated with a low profile and positioned on the control panel for ease of access and visibility and for avoidance of unintended actuation.

4. The all-earth foundation trencher of claim 3 wherein:

the directional indicator includes precise measurement, readout and fixedly automatic control of steering-control alignment for precise directional control of trench digging; and the verticality indicator includes laser-precision measurement, readout and fixedly automatic control of body verticality for precise verticality control of trench digging with the digger head).

5. The all-earth foundation trencher of claim 1 wherein:

the earth-mover blade includes an earth-mover blade that is articulated for having plural-way controllability of blade orientation on the blade control beams.

6. The all-earth foundation trencher of claim 5 wherein:

the blade controller includes a ball-and-socket controller having a ball that is rotational universally in socket in a blade plate with the ball-and-socket controller being articulated for controlling orientation of the earth-mover blade;

the ball having an epicentral knob that is rotational clockwise from a directional-reference point on the blade plate for clockwise steering of the earth-mover blade and that is rotational counterclockwise from the directional-reference point on the blade plate for steering the earth-mover blade counterclockwise from orthogonality to a linear axis of the track-laying chassis;

the epicentral knob is pivotal downward for orienting the earth-mover blade clockwise from horizontality and is pivotal upward for orienting the earth-mover blade counterclockwise from horizontality;

the epicentral knob is pivotal horizontally forward for orienting the earth-mover blade clockwise from verticality and is pivotal vertically upward for orienting the earth-mover blade counterclockwise from verticality; and the ball-and-socket controller being articulated with a low profile and positioned on the control panel for ease of access and visibility and for avoidance of unintended actuation.

7. The all-earth foundation trencher of claim 6 wherein:

the ball-and-socket controller includes precise measurement, readout and fixedly automatic control of orientation of the earth-mover blade for desirably precise mechanized clearing, grading and leveling of foundation-trench areas, for accurate track mobility and for reliable piling of removed earth beside foundation trenches.

8. The all-earth foundation trencher of claim 1 wherein:

the boom controller includes a boom-controller knob that is articulated for controlling the digger boom with a depth point that is rotational clockwise selectively intermediate an up mark and a down mark on a boom plate on the control panel for lowering the digger boom and the depth point is rotational counterclockwise selectively intermediate the down mark and the up mark for raising the digger boom; and the boom-controller knob is articulated with a low profile and positioned on the control panel for ease of access and visibility and for avoidance of unintended actuation.

9. The all-earth foundation trencher of claim 8 wherein:

the boom controller includes selectively precise measurement, readout and fixedly automatic control of digging depth of the digger head by rotation of the boom-controller knob.

10. The all-earth foundation trencher of claim 9 wherein:

measurement of digging depth includes incremental marks on the boom plate intermediate the up mark and the down mark.

11. The all-earth foundation trencher of claim 1 wherein:

the head controller includes a dig-width knob articulated for controlling dig width of the digger head, a head-slant knob articulated for controlling slant of the digger head and dig-speed knob articulated for controlling dig speed of the digger head;

the dig-width knob having a width point that is rotational selectively intermediate a min-width mark and a max-width mark on a width-indicator plate for width control;

the head-slant knob having a slant point that is rotational selectively intermediate a no-slant mark and a max-slant mark on a slant-indicator plate for slant control; and the dig-speed knob having a speed point that is rotational selectively intermediate a stop mark and a max-speed mark on a speed-indicator plate for dig-speed control.

12. The all-earth foundation trencher of claim 11 wherein:

the dig-width knob, the head-slant knob and the dig-speed knob include a group of three separate knobs on the control panel.

13. The all-earth foundation trencher of claim 11 wherein:

the head controller is articulated with a low profile and positioned on the control panel for ease of access and visibility and for avoidance of unintended actuation.

14. The all-earth foundation trencher of claim 1 wherein:

the digger head includes a central digger chain, a left digger chain and a right digger chain;

the central digger chain is positioned on chain-sprocket teeth of a top-central chain wheel and on bottom-central chain wheel;

the left digger chain is positioned on chain-sprocket teeth of a top-left chain wheel and on chain-sprocket teeth of a bottom-left chain wheel;

the right digger chain is positioned on chain-sprocket teeth of a top-right chain wheel and on chain-sprocket teeth of a bottom-right chain wheel;

the top-central chain wheel is affixed to a central portion of a top sprocket axle and the bottom-central chain wheel affixed to a central portion of a bottom sprocket axle;

the top-left chain wheel and the top-right chain wheel are in linearly sliding contact with the top sprocket axle;

the bottom-left chain wheel and the bottom-right chain wheel are in linearly sliding contact with the bottom sprocket axle;

the head controller includes a sprocket-wheel slider that is operable by the dig-width knob for controlling dig width of the digger head; and the central digger chain, the left digger chain and the right digger chain include rock-digger blades that are offset for being interspaced predeterminedly.

15. The all-earth foundation trencher of claim 14 wherein:

the digger backboard includes a backboard first side positioned proximate a first side of the digger head and a backboard second side positioned proximate a second side of the digger head; and the backboard first side and the backboard second side have portions that are overlapped selectively for desired combined width thereof.

16. The all-earth foundation trencher of claim 15 wherein:

combined width of the backboard first side and the backboard second side is manipulated by a backboard-width controller in communication with the control-power distributor.

17. The all-earth foundation trencher of claim 16 wherein:

the backboard-width controller is articulated with a low profile that includes a knob positioned on the control panel for ease of access and visibility and for avoidance of unintended actuation.

18. The all-earth foundation trencher of claim 1 wherein:

the compaction controller is articulated with a low profile that includes a knob positioned on the control panel for ease of access and visibility and for avoidance of unintended actuation.

19. The all-earth foundation trencher of claim 1 wherein:

the first-conveyor controller, the second-conveyor controller and the conveyance-direction controller are articulated with low profile that includes at least one knob positioned on the control panel for ease of access and visibility and for avoidance of unintended actuation.

20. The all-earth foundation trencher of claim 1 wherein:

the safety controller is articulated with low profile that includes at least one knob positioned on the control panel for ease of access and visibility and for avoidance of unintended actuation.

21. The all-earth foundation trencher of claim 1 wherein:

the pile controller is articulated with low profile that includes at least one knob positioned on the control panel for ease of access and visibility and for avoidance of unintended actuation.

22. The all-earth foundation trencher of claim 1 and further comprising:

at least one laser guide articulated and positioned proximate the digger head for control-assurance feedback of verticality accuracy of trench digging to an accuracy controller on the control panel.

23. The all-earth foundation trencher of claim 1 wherein:

the control power source includes hydraulic power in communication from the control-power distributor to operational controllers of operational components of the all-earth foundation trencher;

the operational controllers including control communication of hydraulic actuators of the operational components; and control-power communication of the operational controllers with the control-power distributor includes communication through a predetermined control communicator.

24. The all-earth foundation trencher of claim 23 wherein:

the operational controllers include control knobs on knob plates positioned on the control panel; and the operational controllers are articulated for controlling the hydraulic actuators through the control communicator by selective communication with the control knobs.

25. An all-earth foundation trencher comprising:

a digger body having a blade end, a digger end, a first side, a second side and a chassis-attachment base;

a track-laying chassis having a first track and a second track;

a prime mover on the digger body;

a control-power source on the digger body;

the prime mover having power-transfer communication with the control-power source;

a chassis connection in predetermined communication intermediate the chassis-attachment base on the digger body and the track-laying chassis;

a control-power distributor on the digger body;

the control-power source having control-power communication with the control-power distributor;

the chassis connection including track directional communication of control of mobility of the first track and the second tract with a mobility controller in communication with the control-power distributor;

the chassis connector including body-orientational control of orientation that includes at least verticality of the digger body in relationship to orientation of the track-laying chassis with an orientation controller in communication with the control-power distributor;

an earth-mover blade on blade-control beams projected from a blade-attachment portion of the track-laying chassis;

the earth-mover blade having a predetermined plurality of directional orientations controlled by a blade controller in communication with the control-power distributor;

an earth conveyor positioned predeterminedly intermediate the digger head and a conveyor-attachment portion of the track-laying chassis;

the earth conveyor including a first-side conveyor, a second-side conveyor and at least one central conveyor;

the first-side conveyor being manipulated horizontally with at least one first-conveyor control rod having a first-conveyor controller in communication with the control-power distributor;

the second-side conveyor being manipulated horizontally with at least one second-conveyor control rod having a second-conveyor controller in communication with the control-power distributor; and the central conveyor being articulated for conveying earth to the first-side conveyor and to the second-side conveyor selectively with a conveyance-'direction controller in communication with the control-power distributor.

26. The all-earth foundation trencher of claim 25 and further comprising:

at least one laser guide articulated and positioned proximate the digger head for control-assurance feedback of trench digging to an accuracy controller on the control panel.

27. The all-earth foundation trencher of claim 25 wherein:

the control power source includes hydraulic power in communication from the control-power distributor to operational controllers of operational components of the all-earth foundation trencher;

the operational controllers including control communication of hydraulic actuators of the operational components; and control-power communication of the operational controllers with the control-power distributor includes communication through a predetermined control communicator.

28. The all-earth foundation trencher of claim 27 wherein:

the operational controllers include control knobs on knob plates positioned on the control panel; and the operational controllers are articulated for controlling the hydraulic actuators through the control communicator by selective communication with the control knobs.

29. An all-earth foundation trencher comprising:

a digger body having a blade end, a digger end, a first side, a second side and a chassis-attachment base;

a track-laying chassis having a first track and a second track;

a prime mover on the digger body;

a control-power source on the digger body;

the prime mover having power-transfer communication with the control-power source;

a chassis connection in predetermined communication intermediate the chassis-attachment base on the digger body and the track-laying chassis;

a control-power distributor on the digger body;

the control-power source having control-power communication with the control-power distributor;

the chassis connection including track directional communication of control of mobility of the first track and the second tract with a mobility controller in communication with the control-power distributor;

the chassis connector including body-orientational control of orientation that includes at least verticality of the digger body in relationship to orientation of the track-laying chassis with an orientation controller in communication with the control-power distributor;

an earth-mover blade on blade-control beams projected from a blade-attachment portion of the track-laying chassis;

the earth-mover blade having a predetermined plurality of directional orientations controlled by a blade controller in communication with the control-power distributor;

a digger boom pivotal vertically from a boom-attachment portion of the digger body;

the digger boom being manipulated vertically with at least one boom-control rod having a boom controller in communication with the control-power distributor;

a digger head pivotal vertically on a digger-attachment portion of the digger boom;

the digger head being manipulated vertically with at least one head-control rod and the digger head having a head controller in communication with the control-power distributor;

a digger backboard positioned aft of a cutter chain of the digger head for deterring loose earth from falling from the cutter chain;

a compact roller positioned proximate a bottom-aft portion of the digger head;

the compact roller being manipulated vertically on the digger head with at least one compaction-control rod having a compaction controller in communication with the control-power distributor;

an earth conveyor positioned predeterminedly intermediate the digger head and a conveyor-attachment portion of the track-laying chassis;

the earth conveyor including a first-side conveyor, a second-side conveyor and at least one central conveyor;

the first-side conveyor being manipulated horizontally with at least one first-conveyor control rod having a first-conveyor controller in communication with the control-power distributor;

the second-side conveyor being manipulated horizontally with at least one second-conveyor control rod having a second-conveyor controller in communication with the control-power distributor;

the central conveyor being articulated for conveying earth to the first-side conveyor and to the second-side conveyor selectively with a conveyance-direction controller in communication with the control-power distributor;

safety panels manipulated vertically and laterally proximate opposite sides of the digger head with safety control rods having a safety controller in communication with the control-power distributor;

pile blades manipulated vertically and horizontally proximate opposite sides of the digger head with pile-control rods having a pile controller in communication with the control-power distributor;

a pilot house positioned and articulated on the digger body for forward visibility of earth-mover-blade factors and rearward for visibility of earth-digger factors from an operator seat in control-operable proximity to a control panel in operable relationship to the control-power distributor;

the chassis connection includes predetermined universality;

the universality includes directional rotation of the digger body in relationship to linear direction of the first track and the second track of the track-laying chassis;

the universality includes verticality pivot of the digger body in relationship to horizontality of the first track and the second track of the track-laying chassis;

the mobility controller includes a directional indicator having a body-direction point on a control knob for selective steering-control alignment of the digger body and the track-laying chassis by aligning the body-direction point with a chassis-direction point on a knob plate;

the verticality controller includes a verticality indicator having a body-verticality point and a chassis-verticality point on the mobility plate for selectively aligning verticality of the digger body with verticality of the track-laying chassis by aligning the body-verticality point with the chassis-verticality point;

the directional indicator and the verticality indicator being articulated with a low profile and positioned on the control panel for ease of access and visibility and for avoidance of unintended actuation;

the directional indicator includes precise measurement, readout and fixedly automatic control of steering-control alignment for precise directional control of trench digging;

the verticality indicator includes laser-precision measurement, readout and fixedly automatic control of body verticality for precise verticality control of trench digging with the digger head;

the earth-mover blade includes an earth-mover blade having six-way controllability of blade orientation on the blade control beams;

the blade controller includes a ball-and-socket controller having a ball that is rotational universally in socket in a blade plate;

the ball having an epicentral knob that is rotational clockwise from a directional-reference point on the blade plate for clockwise steering of the earth-mover blade and that is rotational counterclockwise from the directional-reference point on the blade plate for steering the earth-mover blade counterclockwise from orthogonality to a linear axis of the track-laying chassis;

the epicentral knob is pivotal downward for orienting the earth-mover blade clockwise from horizontality and is pivotal upward for orienting the earth-mover blade counterclockwise from horizontality;

the epicentral knob is pivotal forward for orienting the earth-mover blade clockwise from verticality and is pivotal upward for orienting the earth-mover blade counterclockwise from verticality;

the ball-and-socket controller being articulated with a low profile and positioned on the control panel for ease of access and visibility and for avoidance of unintended actuation;

the ball-and-socket controller includes precise measurement, readout and fixedly automatic control of orientation of the earth-mover blade for desirably precise mechanized clearing, grading and leveling of foundation-trench areas, for accurate track mobility and for reliable piling of removed earth beside foundation trenches;

the boom controller includes a boom-controller knob having a depth point that is rotational clockwise selectively intermediate an up mark and a down mark on a boom plate on the control panel for lowering the digger boom and the depth point is rotational counterclockwise selectively intermediate the down mark and the up mark for raising the digger boom;

the boom-controller knob is articulated with a low profile and positioned on the control panel for ease of access and visibility and for avoidance of unintended actuation;

the boom controller includes selectively precise measurement, readout and fixedly automatic control of digging depth of the digger head by rotation of the boom-controller knob;

measurement of digging depth includes incremental marks on the boom plate intermediate the up mark and the down mark;

the head controller includes a dig-width knob, a head-slant knob and dig-speed knob;

the dig-width knob having a width point that is rotational selectively intermediate a min-width mark and a max-width mark on a width-indicator plate for width control;

the head-slant knob having a slant point that is rotational selectively intermediate a no-slant mark and a max-slant mark on a slant-indicator plate for slant control;

the dig-speed knob having a speed point that is rotational selectively intermediate a stop mark and a max-speed mark on a speed-indicator plate for dig-speed control;

the head controller is articulated with a low profile and positioned on the control panel for ease of access and visibility and for avoidance of unintended actuation;

the digger head includes a central digger chain, a left digger chain and a right digger chain;

the central digger chain is positioned on chain-sprocket teeth of a top-central chain wheel and on bottom-central chain wheel;

the left digger chain is positioned on chain-sprocket teeth of a top-left chain wheel and on chain-sprocket teeth of a bottom-left chain wheel;

the right digger chain is positioned on chain-sprocket teeth of a top-right chain wheel and on chain-sprocket teeth of a bottom-right chain wheel;

the top-central chain wheel is affixed to a central portion of a top sprocket axle and the bottom-central chain wheel affixed to a central portion of a bottom sprocket axle;

the top-left chain wheel and the top-right chain wheel are in linearly sliding contact with the top sprocket axle;

the bottom-left chain wheel and the bottom-right chain wheel are in linearly sliding contact with the bottom sprocket axle;

the head controller includes a sprocket-wheel slider that is operable by the dig-width knob for controlling dig width of the digger head;

the digger backboard includes a backboard first side positioned proximate a first side of the digger head and a backboard second side positioned proximate a second side of the digger head;

the backboard first side and the backboard second side have portions that are overlapped selectively for desired combined width thereof;

the backboard-width controller is articulated with a low profile that includes a knob positioned on the control panel for ease of access and visibility and for avoidance of unintended actuation;

the compaction controller is articulated with a low profile that includes a knob positioned on the control panel for ease of access and visibility and for avoidance of unintended actuation;

the first-conveyor controller, the second-conveyor controller and the conveyance-direction controller are articulated with low profile that includes at least one knob positioned on the control panel for ease of access and visibility and for avoidance of unintended actuation;

the safety controller is articulated with low profile that includes at least one kn ob positioned on the control panel for ease of access and visibility and for avoidance of unintended actuation; and the pile controller is articulated with low profile that includes at least one knob positioned on the control panel for ease of access and visibility and for avoidance of unintended actuation.

30. The all-earth foundation trencher of claim 29 and further comprising:

at least one laser guide articulated and positioned proximate the digger head for control-assurance feedback of trench digging to an accuracy controller on the control panel.

31. The all-earth foundation trencher of claim 29 wherein:

the control power source includes hydraulic power in communication from the control-power distributor to operational controllers of operational components of the all-earth foundation trencher;

the operational controllers including control communication of hydraulic actuators of the operational components; and control-power communication of the operational controllers with the control-power distributor includes communication through a predetermined control communicator.

32. The all-earth foundation trencher of claim 31 wherein:

the operational controllers include control knobs on knob plates positioned on the control panel; and the operational controllers are articulated for controlling the hydraulic actuators through the control communicator by selective communication with the control knobs.

* * * * *